US005968397A

United States Patent [19]

Wyland et al.

[11] Patent Number: 5,968,397

[45] **Date of Patent: *Oct. 19, 1999**

[54] APPARATUS FOR COOLING A QUARTZ HALOGEN LAMP WITH HEAT CONDUCTING CONVECTOR SECURED TO THE LAMP TERMINAL OR SOCKET

[75] Inventors: Alvin D. Wyland, Williamsburg; Joseph R. Adamski, Cedar Rapids, both of Iowa

[73] Assignee: Amana Company, L.P., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/870,252

[22] Filed: Jun. 6, 1997

[51] Int. Cl.[6] ..... H05B 3/06

[52] U.S. Cl. ..... 219/540; 219/541; 219/405; 392/407; 362/373

[58] Field of Search ..... 392/407, 411–416, 392/422–425; 362/373, 218, 294; 219/405, 411, 530, 540, 541

[56] References Cited

U.S. PATENT DOCUMENTS

| | | | |
|---|---|---|---|
| 3,517,181 | 6/1970 | Daley et al. | 362/373 |
| 3,541,492 | 11/1970 | Fenn | 362/294 |
| 3,936,686 | 2/1976 | Moore | 362/294 |
| 3,974,418 | 8/1976 | Fridrich | 362/218 |
| 3,983,382 | 9/1976 | Troue | 362/218 |
| 4,678,959 | 7/1987 | Mewissen | 362/373 |
| 4,780,799 | 10/1988 | Groh | 362/294 |
| 4,818,849 | 4/1989 | Matlen | 392/411 |
| 4,887,154 | 12/1989 | Wawro et al. | 362/294 |
| 4,918,582 | 4/1990 | McIngvale, Jr. et al. | 362/217 |
| 5,142,795 | 9/1992 | Abbott | 392/411 |
| 5,219,221 | 6/1993 | Yamaka et al. | 362/294 |
| 5,263,874 | 11/1993 | Miller | 439/487 |
| 5,329,436 | 7/1994 | Chiu | 362/294 |
| 5,420,769 | 5/1995 | Ahlgren et al. | 362/294 |
| 5,695,275 | 12/1997 | Markiewicz et al. | 362/294 |
| 5,721,805 | 2/1998 | Cook et al. | 392/420 |

FOREIGN PATENT DOCUMENTS

| | | | |
|---|---|---|---|
| 3112962 | 10/1982 | Germany | 362/218 |
| 7-174984 | 7/1995 | Japan . | |
| 8-106812 | 4/1996 | Japan . | |
| 428937 | 7/1967 | Switzerland | 362/218 |
| 4934 | 2/1914 | United Kingdom | 362/218 |

*Primary Examiner*—Teresa Walberg
*Assistant Examiner*—Shawntina Fuqua
*Attorney, Agent, or Firm*—Tobor, Goldstein & Healey, L.L.P.

[57] ABSTRACT

An apparatus for cooling a quartz halogen lamp is disclosed. Each lamp socket, used for connecting terminals of a quartz halogen lamp to an electrical supply, is mounted to a convector. Heat is conducted away from the terminals to the convector where the heat is then transferred by forced convection to the atmosphere. Alternatively, the convector can be mounted directly to one or more of the terminals. Cooling of the quartz halogen lamp terminals is achieved without passing cooling air directly past the quartz halogen lamp, thereby avoiding problems associated with contamination of the quartz halogen lamp that can lead to premature failure of the quartz halogen lamp.

19 Claims, 4 Drawing Sheets

APPARATUS FOR COOLING A QUARTZ HALOGEN LAMP WITH HEAT CONDUCTING CONVECTOR SECURED TO THE LAMP TERMINAL OR SOCKET

TECHNICAL FIELD OF THE INVENTION

The present invention is directed generally to halogen lamps, and more specifically, to an apparatus for cooling electrical contact terminals of quartz halogen lamps used in heating appliances, such as ovens.

BACKGROUND OF THE INVENTION

Ovens and other heating appliances which use quartz halogen lamps as the source of radiant energy for heating objects are known. Such ovens typically include a plurality of quartz halogen lamps which are arranged in parallel and adjacent to the ceiling and/or floor of the oven. When the lamps are energized, they emit high power density radiant energy. The heating of objects, such as food, within these ovens results predominantly from this high power density radiant energy. The filaments of these lamps are low in mass and may be operated at very high temperatures (e.g., at about 3000 Kelvin). These characteristics allow food to be cooked quickly with infrared radiation, while not requiring any pre-heating of the oven.

However, each quartz halogen lamp includes one or more terminals, that are used to connect the lamp to a source of electrical energy, and that must be kept at a temperature below 350° C. Above this temperature, seals in the terminals leak and ingest air at an excessive rate, leading to premature failure of the quartz halogen lamp. Therefore, the terminals of the quartz halogen lamp must be cooled to ensure proper operation and long life.

The most common cooling method is to pass air directly over each quartz halogen lamp. Each quartz halogen lamp typically includes an elongated quartz sleeve that encloses a tungsten filament. By passing air over the quartz sleeve, the terminals of the quartz halogen lamp are cooled indirectly. The heat transfer mechanism used in this cooling method is commonly known as forced convection heat transfer. Forced convection heat transfer is governed by the following equation (Newton's law of cooling):

$$Q=h_cA(T_h-T_c)$$

where: Q is the rate of heat transfer (BTU/minute); $h_c$ is a convection heat transfer coefficient that is a function of fluid properties, flow field and surface properties of the object being cooled; A is the effective surface area (i.e. the outer surface area of the cylindrical quartz sleeve) ; $T_h$ is the temperature of the hot surface (i.e. the cylindrical quartz sleeve outer surface); and $T_c$ is the temperature of the colder medium (i.e., the cooling air).

Forced convection heat transfer rates are difficult to quantify, mainly due to the difficulty in determining the magnitude of the convection heat transfer coefficient. However, as the cylindrical quartz sleeve has a relatively small surface area, the rate of heat transfer achieved by passing air directly over each quartz halogen lamp will also be proportionally small. As a result, the temperature of the quartz halogen lamp terminals will be higher than desired, unless the cooling air is at a low temperature and/or is passed across the quartz halogen lamp at a very high mass flow rate.

An additional drawback of forced convection cooling of quartz halogen lamps is that air passing over the lamps introduces airborne dust and grease, that will contaminate the outer surface of the cylindrical quartz sleeve, and that will thereby shorten the useful life of the lamp. (To avoid premature failure, manufacturers of quartz halogen lamps recommend that even small amounts of contamination, such as may be caused by fingerprints, for example, be kept away from the surface of the quartz sleeve of a halogen lamp.)

Accordingly, it is desirable to cool quartz halogen lamps without impinging air directly on the lamp surfaces, especially in an environment such as an oven that has relatively high concentrations of contaminants, such as grease and dust in the air within and around the oven.

The present invention is directed to an apparatus for cooling quartz halogen lamps which solves one or more of the above-noted problems. The invention is particularly advantageous when used in a heating appliance, such as an oven.

SUMMARY OF THE INVENTION

According to a first aspect of the present invention, a lamp fixture includes a quartz halogen lamp having a lamp terminal, and a convector which is in heat exchange contact with the lamp terminal, and which is arranged to conduct heat away from the lamp terminal.

In more detailed aspects of the present invention, the convector includes one or more cooling fins, and a securing means, such as a spring clip, to secure the convector to the lamp terminal.

According to another aspect of the present invention, an oven comprises a source of radiant energy, including a quartz halogen lamp, for supplying radiant energy to a heating chamber, and heat conducting apparatus for conducting heat away from the quartz halogen lamp. The heat conducting apparatus includes a conductor portion and a fin portion, wherein the conductor portion is in thermal contact with the quartz halogen lamp, and isolating structure for isolating the fin portion of the heat conducting apparatus from the quartz halogen lamp so that a cooling fluid supplied to the fin portion of the heat conducting apparatus is isolated from the quartz halogen lamp.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
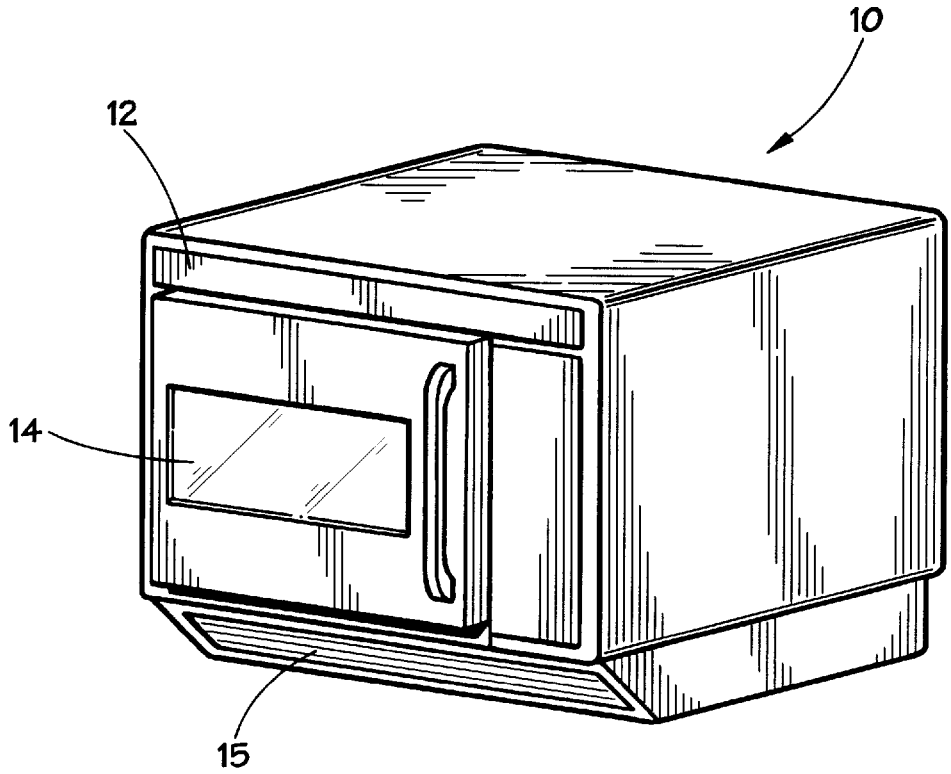
FIG. 1 is an isometric view of a heating appliance utilizing the present invention.

A heating appliance 10 is illustrated in FIG. 1 and includes an upper lamp fixture 12 and a door 14. The door 14 provides access to a heating space within the heating appliance 10. For example, the heating appliance 10 may be an oven for cooking food. The upper lamp fixture 12 is illustrated in more detail in FIGS. 2 and 3. The heating appliance 10 may also have an air intake 15 at its front and an exhaust (not shown) at its rear.

Figure 2:
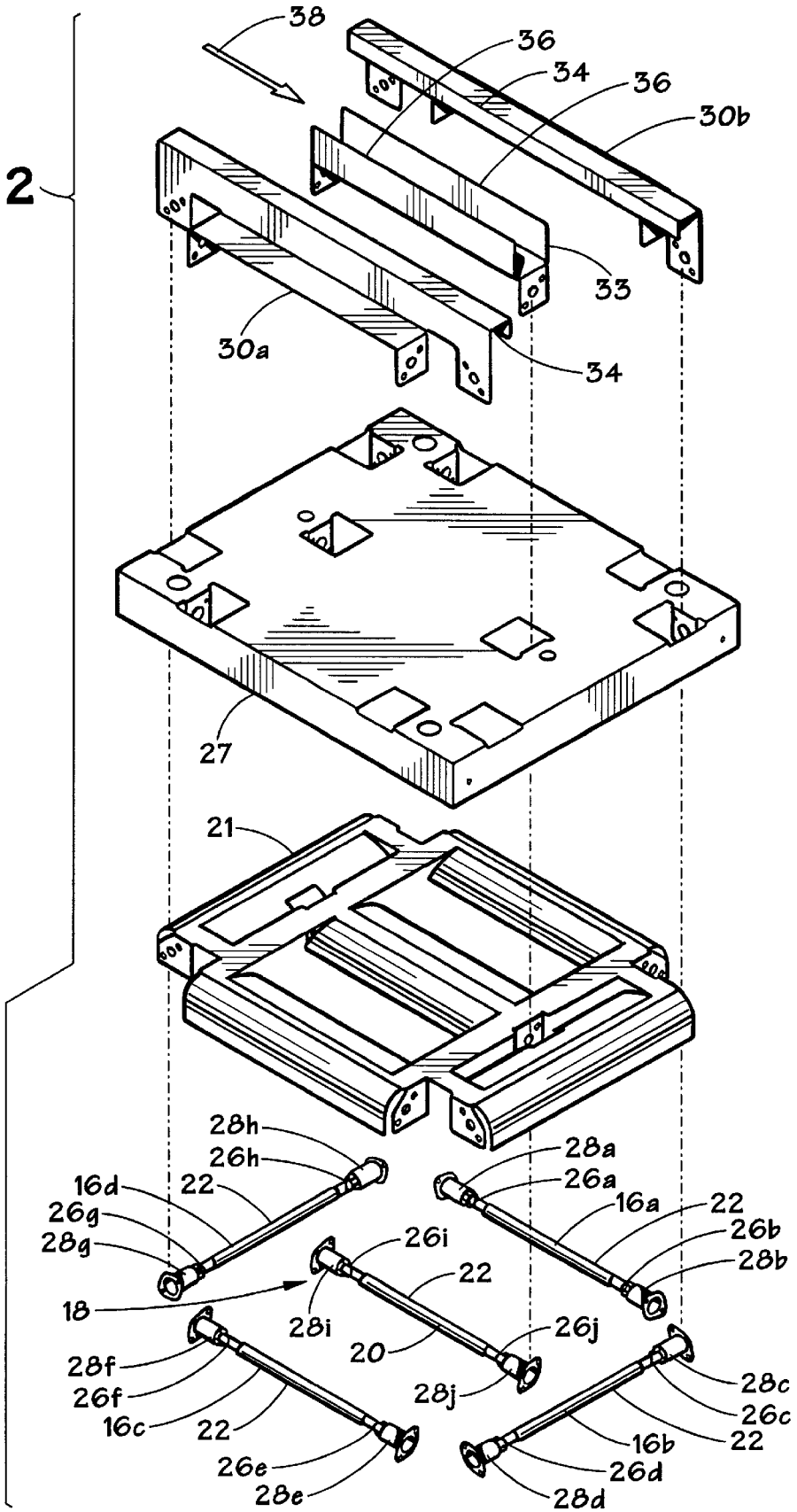
FIG. 2 is an exploded view of an upper lamp fixture for use in connection with the heating appliance shown in FIG. 1.
Figure 3:
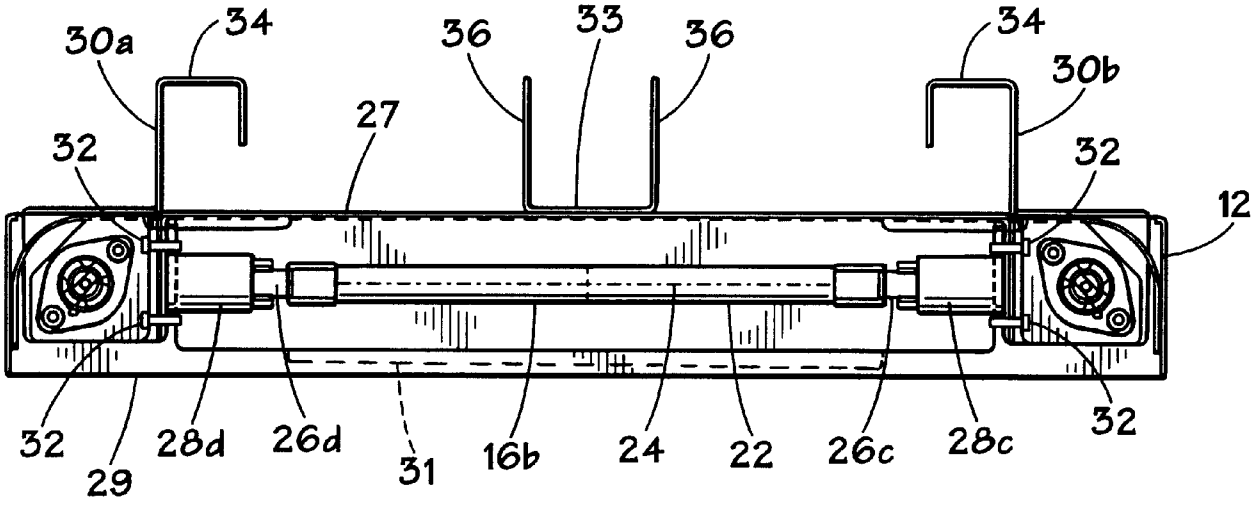
FIG. 3 is a side view of the upper lamp fixture shown in FIG. 2.

The upper lamp fixture 12 illustrated in FIGS. 2 and 3 includes a group of four substantially coplanar quartz halogen lamps 16*a*, 16*b*, 16*c*, and 16*d*, defining a generally rectangular space 18 therebetween. A fifth quartz halogen lamp 20 is disposed substantially coplanar with the quartz halogen lamps 16*a–d* in the generally rectangular space 18.

Each quartz halogen lamp 16*a–d*, 20 includes an elongated quartz sleeve 22 that surrounds a tungsten filament 24. Corresponding terminals 26*a–j* at either end of each quartz halogen lamp 16*a–d*, 20 are electrically connected to the respective tungsten filaments 24. Each elongated quartz sleeve 22 contains halogen gas and is sealed off from the external atmosphere at each terminal 26*a–j*. Molybdenum foil is used as a conductor in the terminals 26*a–j* and to seal each elongated quartz sleeve 22 at the terminals 26*a–j*.

Each quartz halogen lamp 16*a–d*, 20 is enclosed by an upper steel plate portion 27 of the upper lamp fixture 12, disposed above each quartz halogen lamp 16*a–d*, 20, and a lower steel plate portion 29 of the upper lamp fixture 12, disposed below each quartz halogen lamp 16*a–d*, 20. The lower steel plate portion 29 has an opening which is associated with each of the quartz halogen lamps 16*a–d*, 20, which permits radiant energy from each of the quartz halogen lamps 16*a–d*, 20 to enter the heating space of the heating appliance 10, and which is sealed by a ROBAX® glass plate 31 (manufactured by Schott Glass of Germany). An upper aluminum reflector assembly 21 is disposed between the upper steel plate portion 27 and each quartz halogen lamp 16*a–d*, 20.

Electrical power is provided to each quartz halogen lamp 16*a–d*, 20 from a power supply (not shown) through sockets 28*a–j* that securely retain each corresponding terminal 26*a–j*. In order to conduct excess heat away from each quartz halogen lamp 16*a–d*, 20, each socket 28*a–j* is mounted to one of three convectors 30*a*, 30*b*, and 33 using threaded fasteners 32. Although not shown in the figures, it will be understood by those skilled in the art that other means could be employed for securing each socket 28*a–j* to one of the convectors 30*a*, 30*b* and 33 without departing from the scope of the present invention. For example, rivets or welds could be used for this purpose. The sockets 28*a*, 28*h*, 28*b*, and 28*c* are mounted to the convector 30*b*. The sockets 28*g*, 28*f*, 28*e*, and 28*d* are mounted to the convector 30*a*. The sockets 28*i* and 28*j* are mounted to the convector 33. Each convector 30*a*, 30*b* is constructed of aluminum and includes a channel-shaped cooling fin 34. The convector 33 has an overall channel shape, is also constructed of aluminum, and includes two flat cooling fins 36.

By mounting the sockets 28*a–j* to the convectors 30*a*, 30*b*, and 33, heat is conducted from the lamp terminals 26*a–j*, through the sockets 28*a–j* and to the convectors 30*a*, 30*b*, and 33.

The rate of heat transfer corresponding to the rate at which heat is conducted from the lamp terminals may be estimated by the following equation (Fourier's law):

$$Q=((k\,A)/x)\,(T_h-T_c)$$

where: Q is the rate of heat transfer (BTU/minute); k is a material-dependent conduction heat transfer coefficient; A is the effective area through which the heat is conducted (i.e. a cross-sectional area normal to the direction of heat flow); x is the distance heat travels through the heat conductive material from hot to cold regions thereof; $T_h$ is the temperature of the hottest region of the heat conductive material; and $T_c$ is the temperature of the coolest region of the heat conductive material. At a temperature of 212° F. (100 ° C.), aluminum has a conduction heat transfer coefficient, k, of about 119 Btu/(hr ft °F.) (about 206 W/(m K)).

As is the case with convective heat transfer, as mentioned above, conductive heat transfer rates are difficult to quantify, mainly due to the difficulty in determining the magnitude of the effective area. Nonetheless, for typical conditions under which the oven 10 operates, conductive heat transfer is generally accepted to be about an order of magnitude more effective than forced convection.

The lamp terminals 26*a–j* and the sockets 28*a–j* each include an electrically insulating material, such as a ceramic material, that also acts as a thermal insulating material. However, it has been found that superior heat transfer rates may still be achieved using conductive heat transfer to cool the sockets 28*a–j*.

Conductive heat transfer is a much more effective method of heat transfer for cooling the lamp terminals 26*a–j*, as compared to the method of forced convection used when cooling the lamp terminals 26*a–j* indirectly by passing air over each quartz sleeve 22.

The heat is then transferred from each convector 30*a*, 30*b*, and 33 to an air stream, such as that indicated by an arrow 38, that extracts the heat from the convectors 30*a*, 30*b*, and 33 by forced air convection and delivers the heat to the surrounding atmosphere. The air stream may be provided, for example, by a fan (not shown) which is disposed within the heating appliance 10 and which directs cooling air over the cooling fins 34 and not over the quartz halogen lamps 16*a–d*, 20, which are substantially isolated from the air stream by the upper steel plate portion 27, disposed above the quartz halogen lamps 16–*d*, 20, and the lower steel plate portion 29 as well as the glass plate 31, disposed below the quartz halogen lamps 16*a–d*, 20.

Advantageously, the lamp terminals 26*a–j* are cooled without contamination of the quartz sleeve 22, because each quartz halogen lamp 16*a–d*, 20 is substantially isolated from the cooling air passing by each convector 30*a*, 30*b*, and 33, due to the presence of the upper steel plate portion 27 of the upper lamp fixture 12. Also, as the convectors 30*a*, 30*b*, and 33 have a greater surface area than the quartz sleeves 22, heat is move efficiently removed by conducting the heat to the convectors 30*a*, 30*b*, and 33, and then removing the heat from the convectors 30*a*, 30*b*, and 33 by forced air convection, than by using forced air convection directly across the quartz sleeves 22.

Figure 5:
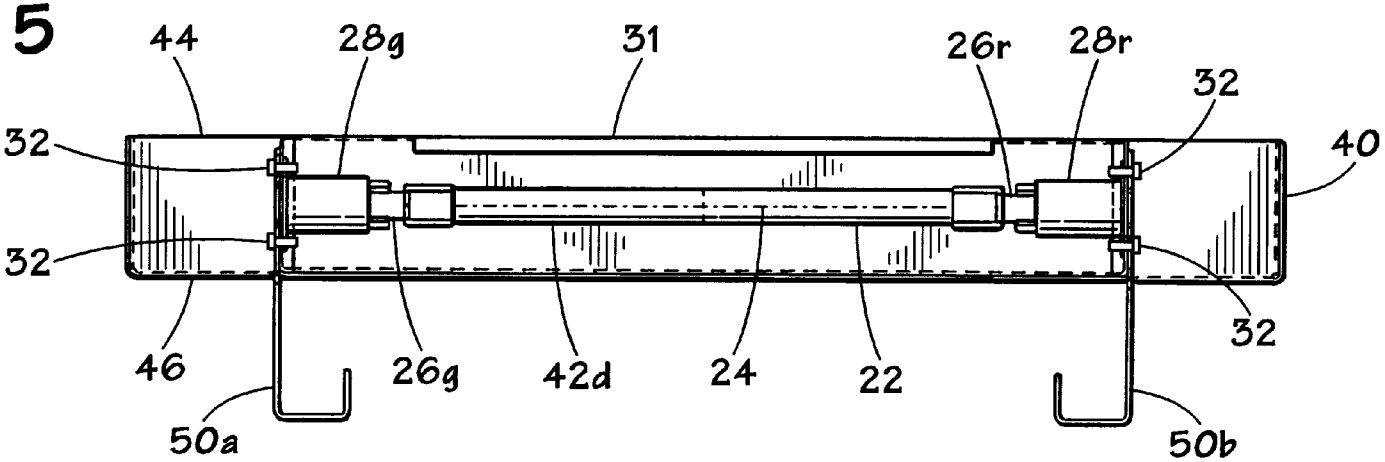
FIG. 5 is a side view of the lower lamp fixture shown in FIG. 4.
Figure 4:
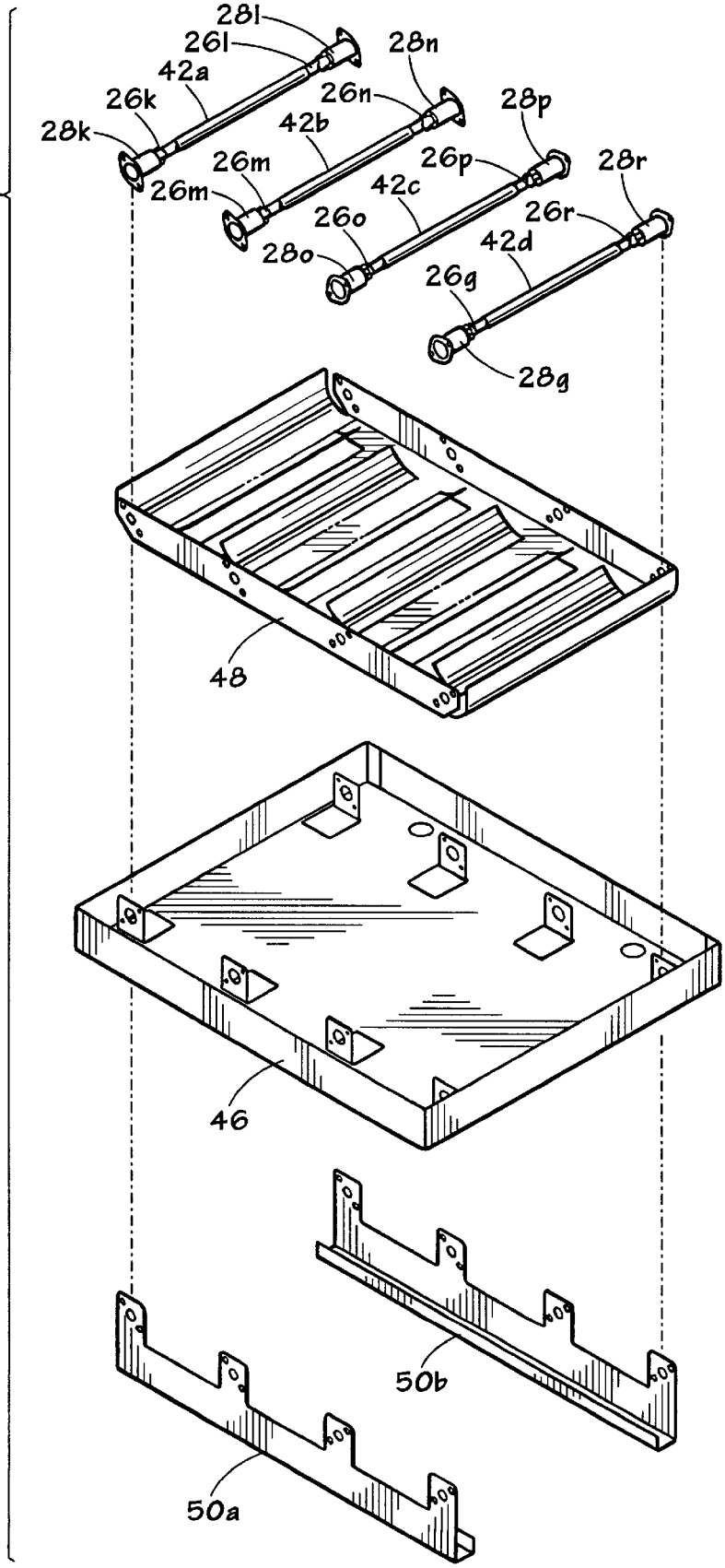
FIG. 4 is an exploded view of a lower lamp fixture for use in connection with the heating appliance shown in FIG. 1.

In addition to the upper lamp fixture 12, the oven 10 also preferably includes a lower lamp fixture 40, shown in FIGS. 4 and 5. The lower lamp fixture 40 includes a group of four substantially coplanar, substantially parallel quartz halogen lamps 42*a*, 42*b*, 42*c*, and 42*d*, similar to the halogen lamps 16*a–d*, 20, and each including a tungsten filament 24. Corresponding terminals 26*k–r* at either end of each quartz halogen lamp 42*a–d* are electrically connected to the respective tungsten filaments 24.

Each quartz halogen lamp 42*a–d* is enclosed by an upper steel plate portion 44 of the lower lamp fixture 40, disposed above each quartz halogen lamp 42*a–d*, and a lower steel plate portion 46 of the lower lamp fixture 40, disposed below each quartz halogen lamp 42*a–d*. The upper steel plate portion 44 has an opening which is associated with each of the quartz halogen lamps 42*a–d*, which permits radiant energy from each of the quartz halogen lamps 42*a–d* to enter the heating space of the heating appliance 10, and which is sealed by a ROBAX® glass plate 31. A lower aluminum reflector assembly 48 is disposed between the lower steel plate portion 46 and each quartz halogen lamp 42*a–d*.

Electrical power is provided to each quartz halogen lamp 42*a–d* from a power supply (not shown) through sockets 28*k–r* that securely retain each corresponding terminal 26*k–r*. In order to conduct excess heat away from each quartz halogen lamp 42*a–d*, each socket 28*k–r* is mounted to one of two convectors 50*a*, 50*b*, using threaded fasteners 32. The sockets 28*k*, 28*m*, 28*o*, and 28*q* are mounted to the convector 50*a*. The sockets 28*l*, 28*n*, 28*p*, and 28*r* are mounted to the convector 50*b*.

Figure 6:
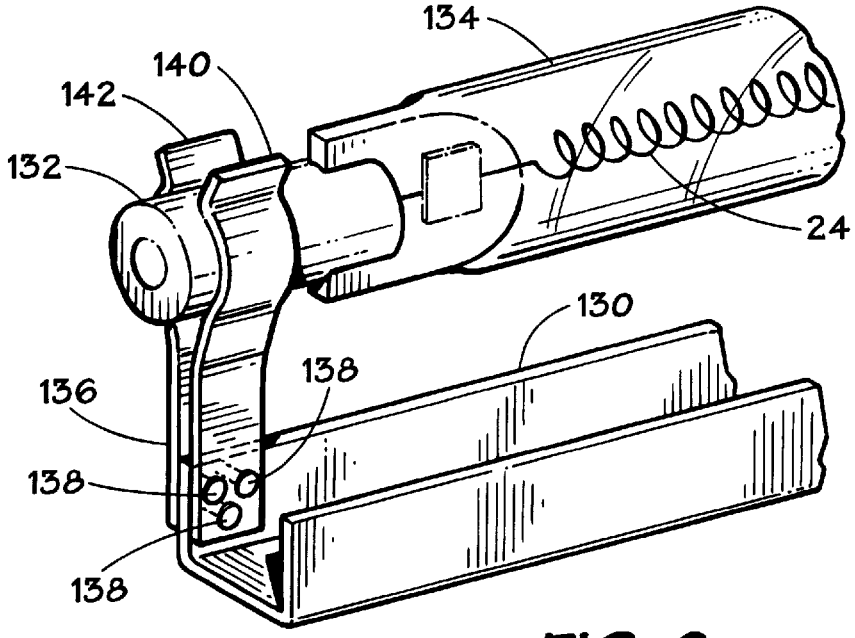
FIG. 6 is an enlarged fragmentary perspective view of an alternative arrangement in accordance with the present invention, in which a convector is secured directly to a terminal of a halogen lamp.

FIG. 6 illustrates an alternative embodiment of the present invention, in which a convector 130 is directly secured to a terminal 132 of a halogen lamp 134 by means of a spring clip 136. The spring clip 136 is mounted to the convector 130 with screws 138, and the spring clip 136 includes gripping portions 140 and 142 that frictionally engage the terminal 132. Although not shown in the figures, it will be understood by those skilled in the art that other means could be employed for securing each spring clip 136 to the convector 130 without departing from the scope of the present invention. For example, rivets or welds could be used for this purpose.

As will be recognized, the arrangement shown in FIG. 6 places the convector 130 in direct heat exchange contact with the terminal 132, thereby enhancing the rate of heat transfer from the terminal 132 to the convector 130.

Certain modifications of the present invention have been discussed above. Other modifications will occur to those practicing in the art of the present invention. For example, the positioning and orientation of each quartz halogen lamp 16*a–d*, 20, 42*a–d* and/or the shape, composition, positioning or orientation of each convector 30*a*, 30*b*, 33, 50*a*, and/or 50*b* could be varied substantially without departing from the present invention. Specifically, each convector 30*a* and 30*b* could be constructed to have more than two cooling fins. Also, fluids other than air could be used to transfer heat away from each convector 30*a*, 30*b*, 33, 50*a*, and/or 50*b*.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An oven comprising:

radiant energy supplying means for supplying radiant energy to a heating chamber, wherein the radiant energy supplying means includes a quartz halogen lamp;

heat conducting means for conducting heat away from the quartz halogen lamp, wherein the heat conducting means includes a conductor portion and a fin portion, wherein the conductor portion is in thermal contact with the quartz halogen lamp; and, isolating means for isolating the fin portion of the heat conducting means from the quartz halogen lamp so that a cooling fluid supplied to the fin portion of the heat conducting means is isolated from the quartz halogen lamp.

2. The oven of claim 1, wherein the isolating means comprises a plate disposed between the fin portion and the quartz halogen lamp.

3. An oven comprising:

a quartz halogen lamp having a quartz sleeve and a plurality of terminals, wherein the quartz halogen lamp and the terminals are enclosed within a lamp enclosure;

a convector for conducting heat away from at least one of the terminals, wherein the convector includes a fin portion, and the convector is in thermal contact with said at least one terminal; and, an isolation plate disposed between the fin portion and the lamp enclosure.

4. The oven of claim 3, wherein the convector has an elongated shape.

5. The oven of claim 4, wherein the elongated shape has a channel-shaped cross section.

6. The oven of claim 3, wherein the isolation plate is disposed between the fin portion and the quartz halogen lamp.

7. An oven comprising:

a plurality of high power density heating lamps, each having two terminals, wherein the high power density heating lamps and the terminals are enclosed within a lamp enclosure;

a convector for conducting heat away from at least one of the terminals, wherein the convector includes a fin portion, and the convector is in thermal contact with said at least one terminal; and, an isolation plate disposed between the fin portion and the lamp enclosure.

8. The oven of claim 7, wherein the convector has an elongated shape.

9. The oven of claim 8, wherein the elongated shape has a channel-shaped cross section.

10. The oven of claim 7, wherein the isolation plate is disposed between the fin portion and the high power density heating lamps.

11. The oven of claim 7 wherein the high power density heating lamps are quartz halogen lamps.

12. An oven subassembly comprising:

a plurality of high power density heating lamps, each having a lamp sleeve and two terminals, wherein the high power density heating lamps and the terminals are enclosed within a lamp enclosure;

a convector for conducting heat away from the terminals of each of the high power density heating lamps, wherein the convector includes a fin portion, and the convector is in thermal contact with the terminals; and, an isolation plate disposed between the fin portion and the lamp enclosure.

13. The oven subassembly of claim 12, wherein the convector has an elongated shape.

14. The oven subassembly of claim 13, wherein the elongated shape has a channel-shaped cross section.

15. The oven subassembly of claim 12, wherein the isolation plate is disposed between the fin portion and the high power density heating lamps.

16. The oven subassembly of claim 12, wherein the convector is directly secured to said at least one terminal.

17. The oven of claim 1, wherein the conductor portion is directly secured to at least one terminal on the quartz halogen lamp.

18. The oven of claim 3, wherein the convector is directly secured to the at least one terminal.

19. The oven of claim 7, wherein the convector is directly secured to the at least one terminal.

* * * * *